United States Patent [19]

Oliver

[11] 4,002,166

[45] Jan. 11, 1977

[54] BYPASSED SCUBA REGULATOR

[75] Inventor: Bill N. Oliver, Huntington Beach, Calif.

[73] Assignee: AMF Incorporated, White Plains, N.Y.

[22] Filed: Apr. 23, 1975

[21] Appl. No.: 570,755

[52] U.S. Cl. ..... 128/142.2

[51] Int. Cl.[2] ..... A62B 7/04

[58] Field of Search ..... 128/142.2, 142, 147, 128/145.8

[56] References Cited

UNITED STATES PATENTS

| | | | |
|---|---|---|---|
| 2,854,001 | 9/1958 | Humblet | 128/142.2 |
| 2,854,972 | 10/1958 | Cummins | 128/142.2 |
| 3,149,631 | 9/1964 | Svenson | 128/142.2 |
| 3,716,053 | 2/1973 | Almovist et al. | 128/142.2 |

*Primary Examiner*—Robert W. Michell
*Assistant Examiner*—Henry J. Recla
*Attorney, Agent, or Firm*—George W. Price; Walter Lewis

[57] ABSTRACT

The regulator control chamber is bypassed by a bypass tube conducting the incoming air directly to the mouthpiece.

1 Claim, 2 Drawing Figures

BYPASSED SCUBA REGULATOR

This invention relates to an improvement in scuba regulators, and more particularly, to a bypassed scuba regulator.

Figure 1:
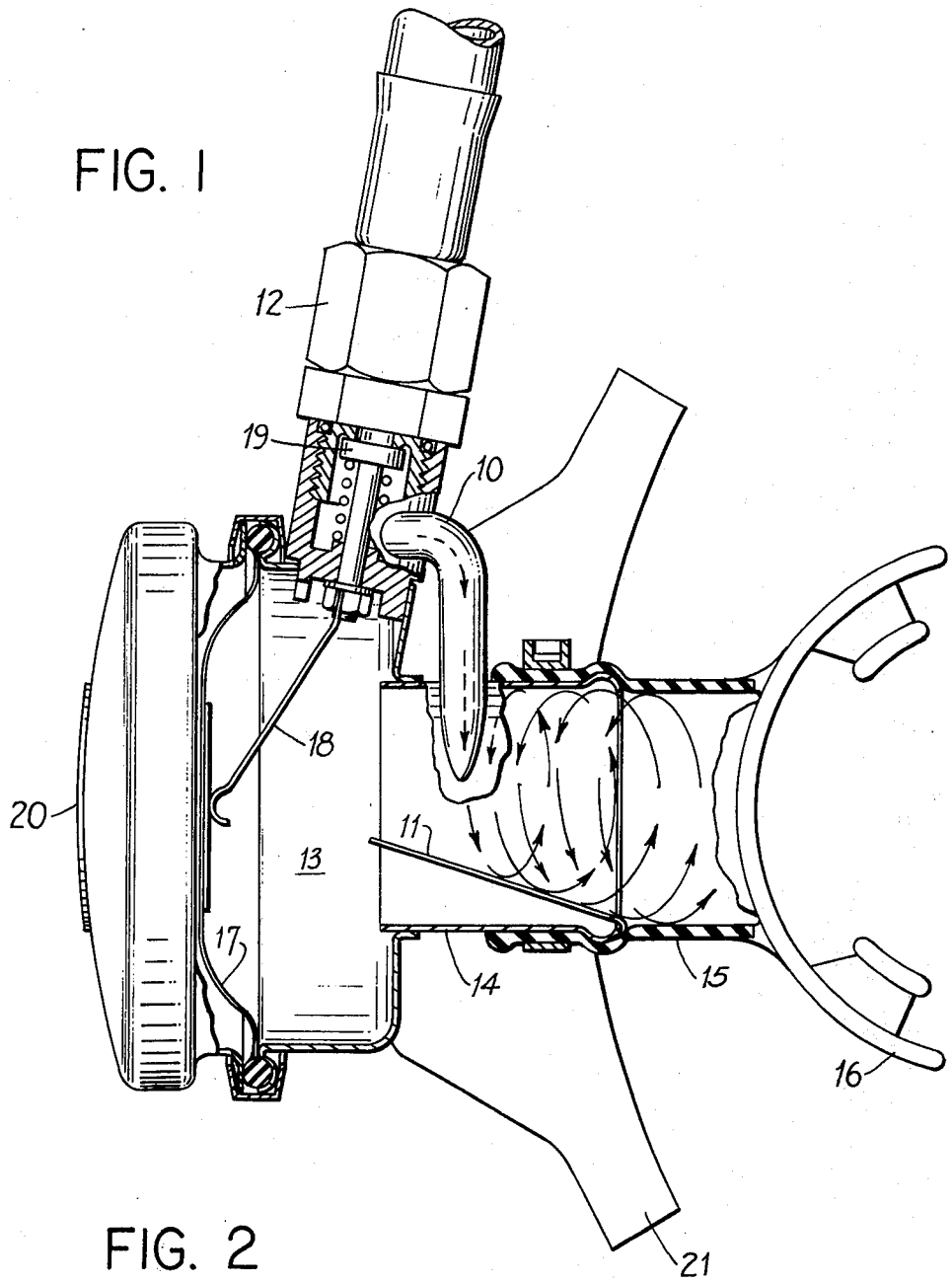
Figure 2:
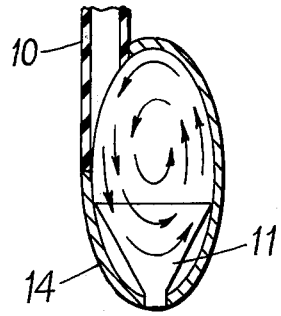

The invention will be best understood by considering the following detailed description taken in connection with the accompanying single sheet of drawing in which FIG. 1 is a broken away plan view of a central device for scuba breathing apparatus and FIG. 2 is a broken away view looking into the mouthpiece tube.

Referring now particularly to the drawing, the demand regulator for the scuba breathing apparatus is conventional except for my improvement embodied in the parts 10 and 11. Part 10 is a tube for bypassing the incoming breathing air from the air supply 12 around the regulator chamber 13 directly to the mouthpiece tube 14. Part 11 is a vane or baffle for adjusting the incoming air flow pattern inside the mouthpiece tube 14, said air flow pattern being illustrated diagrammatically by the swirling arrows in the mouthpiece tube and the tubular connector hose 15 of the mouthpiece 16.

The other parts are conventional and comprise the second stage regulator for scuba or diving equipment comprising a not shown air cylinder and first stage regulator. Briefly, the device comprises the chamber 13 having a flexible diaphragm 17 at one end which operates a lever 18 which in turn operates an on-off valve 19 for the incoming air supply 12. One end of the device is provided with a purge button 20 and the other end with an exhaust tee 21.

The device is similar to Cousteau U.S. Pat. No. 3,095,890 (1963) and Meidenbauer U.S. Pat. No. 2,728,340 (1955). However, in those patents the arrangement is such that the incoming air directly enters the regulator chamber and therefore directly affects the diaphragm unless modifications are made in regulator chamber itself by changing its design or contour, the angle at which the air enters, or utilizing air vanes, baffles, or shields in the chamber itself, or all three. In my invention none of these modifications have to be made in the basic apparatus. Rather, a conventional device can readily have my invention incorporated therein by the mere addition of the bypass tube 10 and the vane 11 to the mouthpiece tube 14.

More particularly, my invention uses the demand principle which is common to all second type scuba regulators. The diver draws breath through the mouthpiece which creates a pressure imbalance across the flexible diaphragm. The force developed by the pressure imbalance causes the diaphragm to depress the demand lever to open the air valve, thus allowing pressurized air to enter. As long as the chamber is continually evacuated by the diver, the demand valve will remain open and the air will continue to flow. Since in prior regulators the air flow is through the regulator chamber, the aerodynamic configuration of the chamber can have a significant effect on the pressure distribution across the diaphragm and the effort the diver must exert to maintain the pressure imbalance and sustain air flow. In my invention better control stability and decreased breathing effort are obtained since the pressurized air is not allowed to enter the regulator control chamber. Instead, the regulator control chamber is bypassed completely and the incoming air flow pattern is in the mouthpiece as far away as possible from the diaphragm. The degree of regulator control stability can be adjusted by adjusting the vane angle in the mouthpiece. However, while this is for maximizing performance, this control is not in the regulator chamber, but in the mouthpiece tube. In my invention, since the incoming air is not in the regulator control chamber, the diaphragm is not influenced by extraneous flow patterns that result from bringing the incoming air directly into the regulator chamber. Also, the bypassed incoming air jet is introduced into the mouthpiece tube in a manner that will impart rotation to the air inside the mouthpiece tube. The vartex created by the air rotation tends to create a low pressure area. As the rotational velocity increases at higher flow rates, the low pressure area communicates with the regulator chamber to assist in opening the demand lever thereby requiring less breathing effort to maintain air flow. As seen from FIG. 2, the bypass tube 10 is connected to the mouthpiece tube 14 at a tangent and the vane 11 extends lengthwise of the mouthpiece tube 14 but at an angle which is inclined toward the tangential connection of the bypass tube 10 to the mouthpiece tube 14. This disposition of the vane assists in causing the air vortex to progress along the mouthpiece tube 14, 15 to the mouthpiece 16 and the vane 11 can be manually adjusted by bending it towards or away from the tube 10.

I claim:

1. In a scuba second stage regulator comprising a regulator control chamber, a flexible diaphragm at one end of said chamber, a mouthpiece tube at another end of said chamber, and an air supply connected to a side of said chamber, said air supply including an air valve, and a demand lever in said chamber which is connected to said valve and in engagement with said diaphragm to be adapted to be actuated by said diaphragm to open and close said valve; the improvement of an air bypass tube extending from said air supply to said mouthpiece tube to bypass the incoming air from said air supply around said control chamber, and said bypass tube having a tangential connection with said mouthpiece tube, and an adjustable air baffle positioned inside said mouthpiece tube, said baffle extending lengthwise of said mouthpiece tube and positioned opposite to said tangential connection at an obtuse angle with respect to the longitudinal axis of said tangential connection; said baffle divergently inclined towards the mouthpiece end of said tube.

* * * * *